US011028667B2

(12) United States Patent
Arsalan et al.

(10) Patent No.: US 11,028,667 B2
(45) Date of Patent: Jun. 8, 2021

(54) WELL COMPLETION SYSTEM

(71) Applicants: Saudi Arabian Oil Company, Dhahran (SA); Wireless Instrumentation Systems AS, Trondheim (NO)

(72) Inventors: Muhammad Arsalan, Dhahran (SA); Stian Marius Hansen, Trondheim (NO); Henrik Wanvik Clayborough, Trondheim (NO); Jarl André Fellinghaug, Leinstrand (NO)

(73) Assignees: Saudi Arabian Oil Company, Dhahran (SA); Wireless Instrumentation Systems AS, Trondheim (NO)

( * ) Notice: Subject to any disclaimer, the term of this patent is extended or adjusted under 35 U.S.C. 154(b) by 272 days.

(21) Appl. No.: 15/832,985

(22) Filed: Dec. 6, 2017

(65) Prior Publication Data

US 2018/0155991 A1 Jun. 7, 2018

Related U.S. Application Data

(60) Provisional application No. 62/430,395, filed on Dec. 6, 2016.

(51) Int. Cl.
*E21B 47/12* (2012.01)
*E21B 33/127* (2006.01)
(Continued)

(52) U.S. Cl.
CPC ..... *E21B 33/146* (2013.01); *E21B 17/006* (2013.01); *E21B 17/1078* (2013.01);
(Continued)

(58) Field of Classification Search
CPC .... E21B 17/006; E21B 17/1078; E21B 23/06; E21B 33/12; E21B 33/127;
(Continued)

(56) References Cited

U.S. PATENT DOCUMENTS 4,320,800 A * 3/1982 Upchurch ..... E21B 33/1246 166/106
5,413,170 A 5/1995 Moore
(Continued)

FOREIGN PATENT DOCUMENTS

WO WO-2014/114510 A2 7/2014
WO WO-2016/175830 A1 11/2016
(Continued)

OTHER PUBLICATIONS

Written Opinion of the International Preliminary Examining Authority for PCT/IB2017/001616, 7 pages (dated Oct. 24, 2018).
(Continued)

*Primary Examiner* — Caroline N Butcher
(74) *Attorney, Agent, or Firm* — Choate, Hall & Stewart LLP; Charles E. Lyon; Alexander D. Augst

(57) ABSTRACT

An example system for a well includes a tubing string including spoolable, flexible, coiled tubing to transport fluids within the well; a packer associated with the tubing string to provide an annular seal to a section of a wellbore of the well; a power generator associated with the tubing string to generate power for the system based on fluid flow within the well; a wireless communication device associated with the tubing string to exchange information with one or more components of the system; one or more sensors associated with the tubing string to sense one or more environmental conditions in the well; one or more processing devices associated with the tubing string to generate at least some of the information based on the one or more environmental conditions; and one or more inflow control valves to control a rate of fluid flow into the system.

20 Claims, 8 Drawing Sheets

(51) Int. Cl.

| | |
|---|---|
| ***E21B 23/06*** | (2006.01) |
| ***E21B 41/00*** | (2006.01) |
| ***E21B 43/12*** | (2006.01) |
| ***E21B 34/06*** | (2006.01) |
| ***E21B 17/00*** | (2006.01) |
| ***E21B 33/12*** | (2006.01) |
| ***E21B 47/01*** | (2012.01) |
| ***E21B 47/06*** | (2012.01) |
| ***E21B 33/14*** | (2006.01) |
| ***E21B 33/16*** | (2006.01) |
| ***E21B 44/00*** | (2006.01) |
| ***E21B 33/13*** | (2006.01) |
| ***E21B 17/10*** | (2006.01) |
| ***E21B 47/13*** | (2012.01) |
| ***E21B 47/10*** | (2012.01) |

(52) U.S. Cl.
CPC ..... *E21B 23/06* (2013.01); *E21B 33/12* (2013.01); *E21B 33/127* (2013.01); *E21B 33/1277* (2013.01); *E21B 33/13* (2013.01); *E21B 33/16* (2013.01); *E21B 34/06* (2013.01); *E21B 41/0035* (2013.01); *E21B 41/0042* (2013.01); *E21B 41/0085* (2013.01); *E21B 43/12* (2013.01); *E21B 44/005* (2013.01); *E21B 47/01* (2013.01); *E21B 47/06* (2013.01); *E21B 47/10* (2013.01); *E21B 47/12* (2013.01); *E21B 47/13* (2020.05)

(58) Field of Classification Search
CPC .... E21B 33/1277; E21B 33/13; E21B 33/146; E21B 33/16; E21B 34/06; E21B 41/0035; E21B 41/0042; E21B 41/0085; E21B 43/12; E21B 44/005; E21B 47/01; E21B 47/06; E21B 47/10; E21B 47/12; E21B 47/122
See application file for complete search history.

(56) References Cited

U.S. PATENT DOCUMENTS

| | | | | |
|---|---|---|---|---|
| 5,782,261 | A * | 7/1998 | Becker | E21B 23/03 137/155 |
| RE36,723 | E | 6/2000 | Moore et al. | |
| 6,082,454 | A * | 7/2000 | Tubel | E21B 17/20 166/250.15 |
| 6,321,842 | B1 * | 11/2001 | Pringle | E21B 23/03 166/194 |
| 6,684,952 | B2 | 2/2004 | Brockman et al. | |
| 7,185,703 | B2 | 3/2007 | Jannise et al. | |
| 8,240,382 | B2 | 8/2012 | Krush | |
| 8,408,300 | B2 | 4/2013 | Simancas et al. | |
| 8,794,323 | B2 | 8/2014 | Luce et al. | |
| 8,839,850 | B2 | 9/2014 | Algeroy et al. | |
| 9,598,921 | B2 | 3/2017 | Heijnen et al. | |
| 2004/0020643 | A1 * | 2/2004 | Thomeer | E21B 47/01 166/250.01 |
| 2009/0166045 | A1 | 7/2009 | Wetzel et al. | |
| 2010/0243243 | A1 | 9/2010 | Chen et al. | |
| 2011/0192596 | A1 * | 8/2011 | Patel | E21B 47/13 166/250.11 |
| 2012/0067567 | A1 * | 3/2012 | Rytlewski | E21B 41/0085 166/250.01 |
| 2012/0186808 | A1 * | 7/2012 | Lively | B29C 53/56 166/241.6 |
| 2016/0017693 | A1 * | 1/2016 | Winslow | E21B 41/0085 175/95 |
| 2019/0376371 | A1 | 12/2019 | Arsalan et al. | |
| 2020/0048994 | A1 | 2/2020 | Arsalan et al. | |

FOREIGN PATENT DOCUMENTS

| | | | |
|---|---|---|---|
| WO | WO-2017/074352 | A1 | 5/2017 |
| WO | WO-2018/104778 | A1 | 6/2018 |

OTHER PUBLICATIONS

International Preliminary Report on Patentability for PCT/IB2017/001616, 17 pages (dated Feb. 28, 2019).

International Search Report for PCT/IB2017/001616, 7 pages (dated May 24, 2018).

Written Opinion for PCT/IB2017/001616, 13 pages (dated May 24, 2018).

* cited by examiner

WELL COMPLETION SYSTEM

RELATED APPLICATIONS

This application claims benefit of U.S. Provisional Patent Application Ser. No. 62/430,395, filed Dec. 6, 2016, entitled "THRU-TUBING RETRIEVABLE INTELLIGENT COMPLETION SYSTEM," the disclosure of which is incorporated herein by reference in its entirety.

TECHNICAL FIELD

This specification describes an example well completion system.

BACKGROUND

In the oil and gas industry, completion of a well includes preparing the well for production. There are several options for well completion, one of which is open hole completion. In some open hole completions, the well wall is lined neither with a (removable) liner nor with a cemented casing. Open hole completions such as these are often used in horizontal wells due to technical difficulties and expenses associated with cementing permanent casing in a horizontal well. An example of a horizontal well is a well that includes a wellbore that is non-vertical, at least partly.

SUMMARY

This specification describes example technologies for spoolable modular well completion systems that may be run independently or in conjunction with an existing well infrastructure. The example well completion systems may be used with oil wells or with any other appropriate type of well. The example well completion system may be installed independently in an open hole well, and may include its own components for sealing, anchoring, and managing inflow. The example well completion system may also include components for power generation, energy storage, and communication. Such a system may be configured to be run as one or more simple compartment sections, or as a full lateral well system.

An example system includes a system for a well. The example system includes a tubing string including spoolable, flexible, coiled tubing to transport fluids within the well; a packer associated with the tubing string to provide an annular seal to a section of a wellbore of the well; a power generator associated with the tubing string to generate power for the system based on fluid flow within the well; a wireless communication device associated with the tubing string to exchange information with one or more components of the system; one or more sensors associated with the tubing string to sense one or more environmental conditions in the well; one or more processing devices associated with the tubing string to generate at least some of the information based on the one or more environmental conditions; and one or more inflow control valves to control a rate of fluid flow into the system. The example system may include one or more of the following features, either alone or in combination.

The system may further include an energy storage unit to provide back-up power in cases where the power generator does not provide power. The system may further include one or more centralizers to engage a wall of the wellbore and to bias a body of the system away from the wall. The system may further include a module. The module may include the power generator, the wireless communication device, the one or more sensors, the one or more processing devices, and the one or more inflow control valves.

The module may be retrievable. The packer may expandable to engage the wellbore. The packer may be expandable to engage an anchor in the wellbore.

The module may include the power generator, the wireless communication device, the one or more sensors, the one or more processing devices, and the one or more inflow control valves. The power generator may include a turbine-generator system to generate electrical power for electrical devices associated with the module. The power generator may include a hydraulic vane motor-generator system to generate electrical power for electrical devices associated with the module.

The energy storage unit may include one or more batteries. The one or more batteries may include one or more rechargeable batteries. The one or more batteries may include a non-rechargeable battery. The one or more sensors may include at least one of: a pressure sensor, a temperature sensor, a flow meter, a water cut sensor, or an inflow control valve position sensor.

The module may include the power generator, the wireless communication device, the one or more sensors, the one or more processing devices, and the one or more inflow control valves. The pressure sensor may be configured to sense a pressure of fluid surrounding the module. The pressure of fluid may be one of the environmental conditions in the well.

The module may include the power generator, the wireless communication device, the one or more sensors, the one or more processing devices, and the one or more inflow control valves. The temperature sensor may be configured to sense a temperature of fluid surrounding the module. The temperature of fluid may be one of the environmental conditions in the well.

The module may include the power generator, the wireless communication device, the one or more sensors, the one or more processing devices, and the one or more inflow control valves. The flow meter may be configured to sense a flow rate of fluid into the module.

The module may include the power generator, the wireless communication device, the one or more sensors, the one or more processing devices, and the one or more inflow control valves. The water cut sensor may be configured to sense water content of fluid surrounding the module.

The module may include the power generator, the wireless communication device, the one or more sensors, the one or more processing devices, and the one or more inflow control valves. The inflow control valve position sensor may be configured to sense a position of an inflow control valve. The inflow control valve may be configured to regulate a flow rate of fluid into the module.

The module may include the power generator, the wireless communication device, the one or more sensors, the one or more processing devices, and the one or more inflow control valves. The one or more processing devices may include, or constitute, a control unit. The control unit may be configured to control an active inflow control valve regulating a flow rate of fluid into the module.

The module may include the power generator, the wireless communication device, the one or more sensors, the one or more processing devices, and the one or more inflow control valves. The tubing string may be a first tubing string and the module may be a first module. The system may include a spacer. The spacer may be for separating the first tubing string from a second tubing string. The second tubing string may include a second module. The second module may include: a second power generator to generate power for the second module from fluid flow within the well; a second wireless communication device to exchange second information with one or more components of the system; one or more second sensors to sense one or more environmental conditions in the well; one or more second processing devices to generate at least some of the second information based on the one or more environmental conditions; and one or more second inflow control valves. The spacer may include a latching mechanism, or a polished bore receptacle, or both.

An example method includes deploying, into a well including a wellbore, a system including a tubing string to transport fluids within the well; deploying a packer associated with the tubing string to provide an annular seal to a section of the wellbore; generating power for a module associated with the tubing string in the wellbore, with the power being generated based on fluid flow within the wellbore; sensing one or more environmental conditions within the wellbore, with the sensing being performed by one or more sensors associated with the module; generating information based on the one or more environmental conditions, with the information being generated by one or more processing devices included in the module; and communicating at least some of the information to one or more other components of the system. The communicating may be performed by a wireless communication device.

An example system is or includes s thru-tubing completion system including: a sub-surface completion unit (SCU) configured to pass through production tubing disposed in a wellbore of a well and to be disposed in a target zone of an open-holed portion of the wellbore. The sub-surface completion unit may include: a SCU wireless transceiver; and one or more SCU anchoring seals configured to be positioned in an un-deployed position or a deployed positon, with the un-deployed positon of the one or more SCU anchoring seals for enabling the SCU to pass through the production tubing disposed in the wellbore of the well, and with the deployed positon of the one or more SCU anchoring seals for providing a seal against a wall of the target zone of the open-holed portion of the wellbore to provide zonal isolation between regions in the wellbore. The sub-surface completion unit may include one or more SCU centralizers configured to be positioned in an un-deployed position or a deployed positon, with the un-deployed positon of the one or more SCU centralizers enabling the SCU to pass through the production tubing disposed in the wellbore of the well, and with the deployed positon of the one or more SCU centralizers positioning the SCU in the target zone of the open-holed portion of the wellbore. The sub-surface completion unit may include a downhole wireless transceiver configured to be disposed in the wellbore of the well, to be communicatively coupled to a surface control system for the well, to communicate wirelessly with the SCU wireless transceiver, and to provide for communication between the SCU wireless transceiver and the surface control system.

Any two or more of the features described in this specification, including in this summary section, may be combined to form embodiments not specifically described in this specification.

All or part of the methods, systems, and techniques described in this specification may be implemented as a computer program product that includes instructions that are stored on one or more non-transitory machine-readable storage media, and that are executable on one or more processing devices. Examples of non-transitory machine-readable storage media include, for example, read-only memory, an optical disk drive, memory disk drive, random access memory, and the like. All or part of the methods, systems, and techniques described in this specification may be implemented as an apparatus, method, or system that includes one or more processing devices and memory storing instructions that are executable by the one or more processing devices to perform the stated operations.

The details of one or more implementations are set forth in the accompanying drawings and the description. Other features and advantages will be apparent from the description and drawings, and from the claims.

DETAILED DESCRIPTION

This specification describes example modular well completion systems that may be run independently or in conjunction with an existing well infrastructure. The example systems may be used with oil wells or with any other appropriate type of well.

Figure 1A:
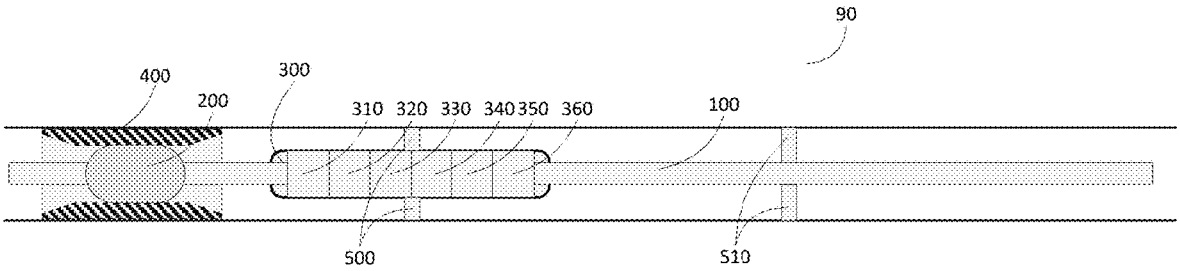
FIGS. 1A to 1C are diagrams showing cut-away, side views of example sections of a well completion system.

Part of an example well completion system 90 is shown in FIG. 1A. Example well completion system ("the well completion system") 90 includes a tubing string 100 to transport fluids within a well; a packer, such as packer 200, associated with the tubing string to provide an annular seal to a section of the wellbore; and a module 300 associated with the tubing string. An example of a packer is a device that creates a seal between the outside of tubing, such as production tubing, and the inside of a hole, such as a casing wall, liner wall, or wellbore wall.

In this example, module 300 includes a local energy system that includes components such as power generator 310 to generate power for the module from fluid flow within the well or energy storage unit 320 to provide back-up power to the module in cases where the power generator does not provide power to the module, or both. In this example, module 300 includes a local communication system, such as wireless communication unit 330, to exchange information with one or more components of the well completion system; a local sensing system that is or includes one or more sensors, such as sensor 340, to sense one or more environmental conditions in the well or conditions of the well completion system; and a local flow control system that is or includes, for example, an inflow control valve 350 to control the flow of fluid from the well into the well completion system. In some implementations, the local communication system includes a wireless transceiver or appropriate other wireless communication circuitry. In this example, module 300 also includes one or more local control systems that are or include, for example, processing device 360 to generate at least some of the information based on the environmental conditions, to control at least the inflow control valve, or both.

In some implementations, the well completion system includes a positioning control system. In some implementations, the well completion system engages or includes a permanent anchor, such as permanent anchor 400, in the wellbore to anchor the well completion system to an inside wall of a wellbore. In some implementations, the well completion system includes one or more subsurface completion units (SCUs). In some implementations, a SCU includes a modular SCU formed of one or more SCU modules (SCMs). In some implementations an SCM is or includes module 300.

In some implementations, the well completion system includes one or more centralizers 500. A centralizer may include a member, such as an arm or hoop, that can be extended radially to engage the wall of the wellbore and to bias a body of module 300 away from the wall of the wellbore. In some implementations, the well completion system includes one or more tubing centralizers 510. A tubing centralizer may include a member, such as an arm or hoop, that can be extended radially to engage the wall of the wellbore and bias tubing string 100 away from the wall of the wellbore.

In some implementations, the tubing string may be deployed to, or delivered to, the wellbore on its own or in combination with one or more other components. In some implementations, packer 200 and module 300 may be delivered to the wellbore separately from the tubing string, for example via wireline, which is a mechanism that employs a cable to lower a tool or other device into the wellbore. In some implementations, packer 200 and module 300 may be delivered with tubing string 100, for example on coiled tubing string.

The well completion system may include a power generator 310 to generate, or to harvest, electrical power for sensing, control, and communication implemented by module 300. The power generator may be used in lieu of, or in addition to, a power infrastructure, such as cables from the well surface. Power may be generated from fluid flow from the well, or from system vibrations. Energy storage unit 320, may store mechanical or electrochemical energy. For example, electrochemical energy may be stored in rechargeable batteries.

Wireless communication unit 330 may communicate data from module 300 to a surface device, such as a computer system, or may communicate commands from the surface device to module 300 or to processing devices 360, for example, to control inflow control valve (ICV) 350. In some implementations, processing devices 360 are, or include, one or more microprocessors or computers, such as those described in this specification. Data and commands may be communicated wirelessly for thousands of feet, as in the case of long lateral wells. One or more sensors 340, may include one or more of the following: flow sensors, pressure sensors, or temperature sensors. Different types of sensors may be used, where appropriate.

Figure 1B:
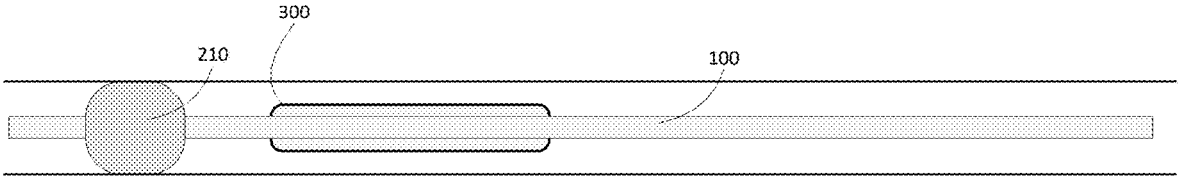

The well completion system may include packer 200 that is inflatable and that engages permanent anchor 400 in the wellbore to anchor the well completion system. One or more permanent anchors 400 may be deployed prior to deployment of the well completion system. In some implementations, the well completion system includes an extreme expendable packer (EEP) 210 that engages directly the inside wall of a wellbore, as shown in FIG. 1B.

Figure 1C:
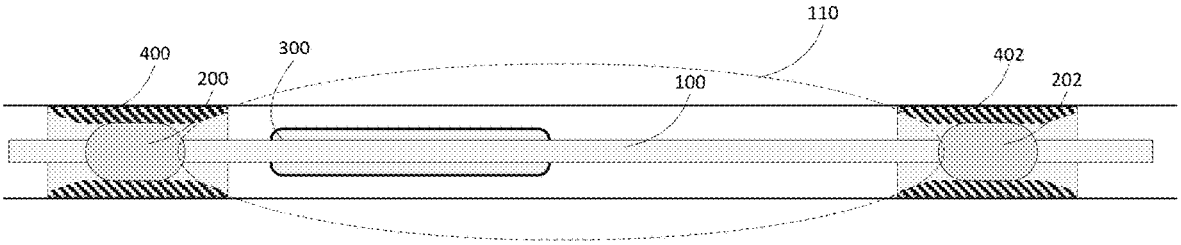

Deployment of a packer, an anchor, or a permanent packer may form a seal in the wellbore. A resulting sealed-off section of wellbore is referred to as compartment. The components of a wellbore completion system in a compartment are referred to as a compartment string. An example compartment, including compartment string 110, packers 200 and 202, and permanent anchors 400 and 402, is shown in FIG. 1C.

In some implementations, the example well completion system is compatible with coiled tubing intervention operations. In some implementations, tubing string 100 is, or includes, coiled tubing. In an example, coiled tubing includes a relatively long, continuous length of pipe that can be wound in a coil around a spool. In some implementations, a coiled tubing string can be between 1 inch and 4.5 inches in diameter, however, the well completion system described in this specification is not limited to these, or any other, dimensions. The well completion system may be configured so that the well completion system has physical characteristics similar to those of a coiled tubing string. For example, the well completion system can include module 300, or components of module 300, which may be assembled in tandem with coiled tubing and spooled onto a coiled tubing string reel. Thus, such a system may be configured to be conveyed using coiled tubing intervention methods, such as rig-less insertion of coiled tubing using an injector head to push or to pull the tubing in and out of a hole through pressure control equipment. For example, the well completion system may be part of a coiled tubing assembly—that includes, for example, a bottom hole assembly including a steerable access sub. The well completion system may be wound in a coil around a spool prior to deployment (a "spoolable system") and mounted, for example on a truck or a mobile unit. The well completion system may then be lubricated and delivered through a wellhead absent a rig.

In some implementations, the well completion system, if part of a coiled tubing assembly, can be anchored and left in a wellbore as part of an installation procedure. The rest of the coiled tubing assembly—for example the bottom hole assembly—may be regarded as equipment for conveyance and can be retrieved from the wellbore after installation of the completion system. Conveyance equipment, if present, may be retrieved together with the rest of the coiled tubing or it may be left in hole if required.

In some implementations, the well completion system can be deployed prior to running-in-hole. In an example, running-in-hole includes connecting pipe and lowering the connected pipe into a wellbore in a controlled manner. The well completion system may be installed independently in an open hole well, and may include its own components for sealing, anchoring, and managing inflow. In some implementations, the well completion system may also be installed in conjunction with existing well infrastructure, such as pre-installed structures for sealing, anchoring, and compartmentalization. Such a system may also be configured to be run as one or more simple compartment sections, or as full lateral well system.

The well completion system can be a through-tubing, rig-less, on-demand, modular, and real-time monitoring and control solution used for open-whole horizontal wells. The well completion system can be a free-form platform that can be deployed when needed, rather than required at the initial completion. The well completion system may include a complete through-tubing retrievable completion system implemented as a coiled tubing having a flush outer diameter, to be installed in one run per compartment or lateral well. In some implementations, a lateral well or compartment can be fully populated directly from the coiled tubing reel. The well completion system may be installed fully configured with all appropriate components or features, and may be deployed into an open hole part of a well, for example a well with prior installed landing/sealing zones, to provide full well completion functionality. The well completion system may also be configured as a length of tubing having downhole latching interfaces, for example as part of a previously deployed system.

Example implementations of the well completion may have one or more advantages. For wells in open hole configuration, eliminating the need for a rig for operations and the possibility of on-demand monitoring and control may enable cost and time savings. Robust rig-less open hole well intervention technologies may reduce or eliminate the need for advanced rigged completions, and may be particularly suitable for early-stage wells. Monitoring and control may enable efficient reservoir management, which may enhance well production at much lower cost, while extending the life of a well.

The well completion system may be deployed in an any appropriate type of well including, but not limited to, an open hole oil or gas well. In some implementations, it may be desirable to anchor and to seal the well completion system, or one or more of its components, in an open hole environment. Anchoring or sealing may be implemented using devices and configurations, such as an extreme expandable packer (EEP), or a permanent inflatable packer having an expandable liner (hybrid).

The well completion system may include a packer 200 that is retrievable. A packer may be used alone or in combination with one or more other devices, such as an internal diameter (ID) reducer, to anchor the well completion system in place. The retrievable packer may engage permanent anchor 400 to anchor the well completion system. Together, these components may constitute an anchoring assembly. The well completion system may include an extreme expendable packer (EEP) 210 that engages the inside wall of a wellbore. In some implementations, permanent anchor 400 is, or includes, a landing zone, because the permanent anchor is installed in the wellbore prior to deployment of the well completion system.

In some implementations, the well completion system is held in position and provides a hydraulic seal to one or more production zone(s) or compartments of a well. In some implementations, an anchoring assembly, which may include EEP 210, may seal, or immobilize, the well completion system at a differential pressure of at least 50 psi (pounds-per-square-inch) between two different compartments. In some implementations, an anchoring assembly seals, or immobilizes, the well completion system at a differential pressure of at least 10 psi, 20 psi, 30 psi, 40 psi, 50 psi, 60 psi, 70 psi, 80 psi, 90 psi, 100 psi, 200 psi, 300 psi, 400 psi, or 500 psi. The well completion system, however, is not limited to these differential pressures, and may be implemented using any appropriate differential pressure.

In some implementations, permanent anchor 400 is delivered to a desired location via a tube or liner, such as a 4.5 inches (outer diameter)/3.9 inches (inner diameter) production liner. In some implementations, permanent anchor 400 or EEP 210 is set into a hole having a diameter of at least 6.125 inches. In some implementations, permanent anchor 400 or EEP 210 is set into a hole having a diameter of at least 3 inches, 4 inches, 5 inches, 6 inches, 7 inches, 8 inches, 9 inches or 10.0 inches. In some implementation, the hole is an irregular shaped open hole. The well completion system, however, is not limited to use with these hole or production liner diameters, and may be implemented using any appropriate hole or production liner diameters.

Figure 2:
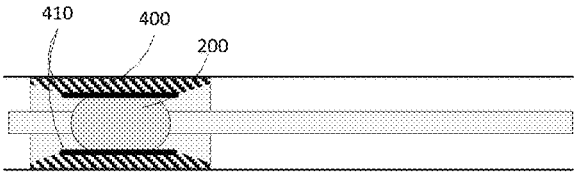
FIG. 2 is a diagram showing cut-away, side views of an example retrievable packer placed inside a landing zone.

Permanent anchor 400, packer 200 or EEP 210, or any component of the anchor or packer, may be or include an expandable system attached to a spooled completion string, or may be preinstalled into the wellbore. In some implementations, permanent anchor 400 is, or includes, a permanently-inflatable packer having an expandable liner. In some implementations, deploying permanent anchor 400 can create one or more landing zones for the well completion system. Permanent anchor 400, which may be implemented using a permanently-inflatable packer having an expandable liner, may serve as a location where retrievable components of the well completion system may be landed and anchored. FIG. 2 shows an example retrievable packer 200 placed inside a landing zone that implements, at least in part, permanent anchor 400. In this case, the permanently-inflatable packer is deployed separately prior to deployment of the remainder of the well completion system. In this example, the permanently-inflatable packer includes a tube having a smaller diameter than the wellbore. In this case, the permanently-inflatable packer having expandable liner 410 and retrievable packer 200 together form the anchor for the well completion system.

Figure 3:
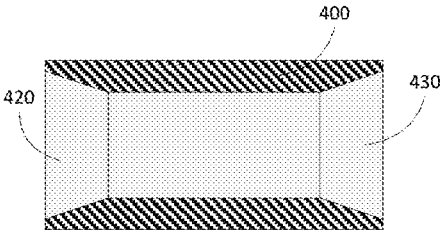
FIG. 3 is a diagram showing an example permanent anchor.

In some implementations permanent anchor 400 includes a first entry funnel functionality 420. The funnel shape may improve ingress or egress, or both, of a tool or string into or out of a landing zone. In some implementations permanent anchor 400 includes a second entry funnel functionality 430. In some implementations, an entry funnel is implemented by flaring out ends of the expandable liner, as shown in FIG. 3.

Figure 4:
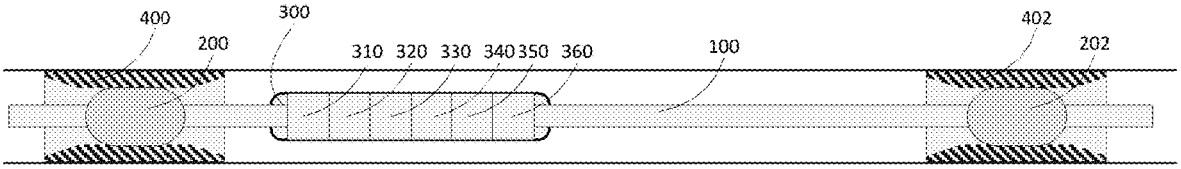
FIG. 4 is a diagram showing a cut-away, side view of an example section of a well completion system.
Figure 5:
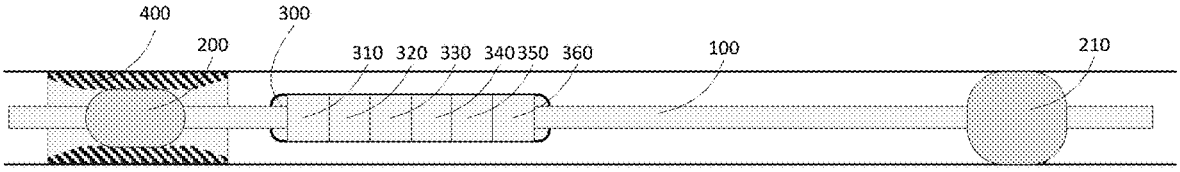
FIG. 5 is a diagram showing a cut-away, side view of an example section of a well completion system.

Referring also to FIG. 4, in some implementations, permanent anchors and packers can be located on each end of an example compartment string 110. Examples include anchors 400, 402, and retrievable packers 200, 202. These can create a pressure barrier in the annulus. A retrievable packer may include a throughbore having an internal diameter that is large enough to allow for intervention through the module and packer, and that does not create an unnecessary pressure drop along a section of tubing that includes one or more packers. In some implementations, the well completion system includes an extreme expandable packer (EEP) that can be used alternatively to, or in combination with, a permanently-inflatable packer having an expandable liner or landing zone. For example, in the case of multiple zones, some zones may be implemented by deploying one or more permanent anchors 400/retrievable packers 200, while other zones in the same well may be implemented by deploying one or more EEPs 210 (see FIG. 5). In some implementations, the well completion system includes a coiled tubing string including one or more EEPs. In some implementations, the well completion system includes an EEP configured to be deliverable through 4.5 inches outer diameter tubing and isolate the production zones, as well as anchor the well completion system in place in a 6.125 inches (or larger) diameter open hole. This may allow deployment of the well completion system in a single run, as the necessity for tractor intervention assembly runs can be eliminated. However, the well completion system is not limited to these or any other dimensions.

The well completion system can be deployed in an oil or gas well, such as an open hole well, which may be too deep or otherwise inaccessible to establish and run a power supply from outside the well. In some implementations, the well completion system is modular, with each module 300 including a separate sensor 340 and a processing device 360, thus requiring a separate power generator 310 or energy storage unit 320, or both.

Power may generated locally in the wellbore using a variety of technologies. These technologies may harvest the energy conveyed by fluid moving through the wellbore, convert heat into power, or may employ electrochemical energy conversion methods. The technologies that may be used include, but are not limited to, a hydraulic turbine coupled with an electric generator, a hydraulic vane motor coupled with an electric generator, a magnetohydrodynamic generator, a thermoelectric generator, a heat pump coupled to an electric generator, a linear motor coupled to a piston or membrane, a paddle cantilever on a piezoelectric stack using, vortex induced vibration (VIV—a fluid vibration phenomenon occurring downstream a blunt body in a moving fluid), a bimorph piezoelectric cantilever using VIV, or a fuel cell harvesting chemical energy from well fluid.

Figure 6:
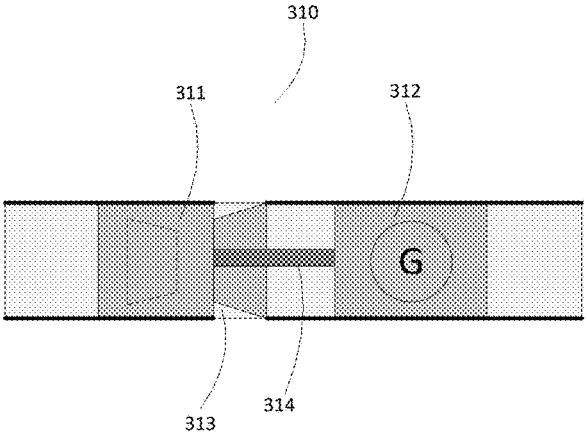
FIG. 6 is a diagram showing an example implementation of a power generator.

In some implementations, power is generated in the well completion system using a power generator 310 that includes a hydraulic turbine 311 coupled with an electric generator 312. In some implementations, fluid from the wellbore enters the well completion system via an inlet, such as inlet 313, and drives the turbine 311 coupled to a generator 312 via shaft 314. An example turbine 311 coupled to a generator 312 is shown in FIG. 6. In some embodiments, a power generator 310 is configured such that a unit including the power generator can be bent to an extent sufficient for a system including the power generator to be spoolable. In some implementations, shaft 314 can be flexible or articulated, for example, including two, three, four or more shafts that are connected via a flexible or a moveable joints.

In some implementations, power is generated in the well completion system using a hydraulic vane motor coupled with an electric generator. In some implementations, the hydraulic vane motor has additional features, such as a downhole control valve capability, and the capability to harvest energy from very small flows.

In some implementations, one or more compartment strings of the well completion system are powered solely by battery power without a power generator such as a mechanical power generator. In some implementations, the one or more batteries are retrievable, replaceable, or rechargeable.

Certain operations of the well completion system, such as actuation of valves or operation of the communication unit, which may occur contemporaneously, may lead to relatively high instantaneous power consumption. In some implementations, one or more local energy storage devices can provide energy to power one or more components of the system. An example of such a device is energy storage unit 320. In some implementations, energy storage unit 320 can operate at temperatures of up to 125° C. and can store sufficient power in the restrictive downhole conditions for an extended period of time, for example, for at least 5 years. However, the well completion system is not limited to these, or any other, values.

An energy storage unit 320 that is usable with the well completion system may store energy using different technologies, including, but not limited to, mechanical storage, thermal storage, electrochemical storage, electrical storage, biological storage, and chemical storage devices. In some implementations, mechanical storage devices include flywheels or gas compression devices. In some implementations, thermal storage includes a thermoelectrical generator, a thermal storage mass, or both a thermoelectrical generator and a thermal storage mass. In some implementations, electrochemical storage includes a rechargeable battery or a non-rechargeable battery, or a combination of these components. In some implementations, electrochemical storage includes a high-temperature rechargeable lithium cell.

In some implementations, the energy storage unit is configured to operate in different modes based on different applications during the operation of the well completion system. For example, the well completion system can operate in four or more different modes: three shut-in modes, in which the well is shut above a certain region, for example a production formation, and thus no fluid flows through the power generator 310, and one flowing well mode, in which fluid is flowing through or around the well completion system. In some implementations, the modes include, but are not limited to:

Mode 1: Shut-in—hibernation

Mode 2: Shut-in—pressure and temperature logging; low duty 1 sample per hour or day Mode 3: Shut-in—pressure and temperature logging; logging 1 sample per second Mode 4: Flowing Well—recharging storage system In some implementations, energy storage unit 320 is scalable and can be remodeled for different applications. However, the well completion system is not limited to these, or any other, values.

In some implementations, the well completion system includes one or more sensors, such as sensor 340. In some implementations, sensor 340 is or includes a pressure sensor, a temperature sensor, a bulk flow sensor, a water cut sensor, or an inflow control valve position sensor. Data collected from one or more sensors can be transmitted to a computing system or other device(s) located at the wellhead or at the surface, or the data can be processed downhole by one or more processing devices 360 in a compartment string. In some implementations, the processing devices 360 are, or include, an electronics vessel.

In some implementations, the well completion system includes a communication unit 330. In some implementations, the communication unit can transmit data including, but not limited to, data for each compartment. Examples of the data may include, but are not limited to, production data such as, pressure measurements, temperature measurements, and flow measurements. The communications unit may also receive control commands, such as control data, to operate components, such as the inflow control valve (ICV) 350. For example, the data may be relayed to processing device 360, which uses the data to implement various downhole controls. In some implementations, the communication unit is a two-way communication unit or a one-way communication unit. In some implementations, the communication unit 330 is used for communication between separate compartment strings of the well completion system, such as modules located in separate compartments. In some implementations, the communication unit 330 is used for communication between a compartment string of the well completion system and an operator located outside the well. In some implementations, the communication unit 330 transmits sensor data to an operator and receives control data from the operator. An example command includes a command to actuate an active inflow control valve 350.

Signals may be generated locally in the wellbore. These signals may include, but are not limited to, electromagnetic signals, magnetic signals, high-frequency acoustic signals, low-frequency acoustic signals, and hydraulic pulse signals. In some implementations, the communication unit 330 includes devices for implementing acoustic communication in fluids and or solids. In some implementations, electromagnetic methods may be used. For example the tubing may be used as one or more antennas for the transmission and reception of electromagnetic signals. In some implementations, electromagnetic signals can be used for communication up the vertical section of a wellbore.

The communication methods and devices described may be used for communication from a compartment string to the surface, from the surface to a compartment string, or from a first compartment string to a second compartment string.

Referring back to FIG. 1A, in some implementations, the well completion system includes one or more processing devices 360 to control the electrical or mechanical components of the well completion system. In some implementations, the control unit controls an inflow control valve (CV) 350, which regulates the amount or flow rate of fluid entering the well completion system, such as fluid entering the tubing string of the well completion system. In some implementations, the inflow control valve 350 is an active flow control valve that controls the production flow from a compartment zone into the well completion system. In some implementations, the inflow control valve 350 can be controlled by well operator inputs from the surface. In some implementations, the inflow control valve position can be measured using a sensor, such as sensor 340, and the information can be sent back to the well operator as a feedback signal. In some implementations, the well completion system includes a passive inflow control device. In some implementations, the inflow control device is a sand screen, or includes slotted inflow ports in the tubing or a combination of both.

In some implementations, the well completion system is modular, and includes a separate control unit for each compartment string. In some implementations, two or more compartment strings may be controlled by a single unit.

In some implementations, two or more components of the well completion system can be configured and arranged in a single combined module, such as module 300, for controlling and monitoring inflow from each compartment. Module 300 may be independent in terms of communication and power supply, and may include one or more of the power, energy or communication technologies described in this specification. In some implementations, module 300 can be retrievable, allowing individual components to be repaired or replaced.

In some implementations, module 300 can include a power generator 310, an energy storage unit 320, a wireless communication unit 330, one or more sensors, such as sensor 340, an inflow control valve 350—which may be an active inflow control valve (ICV) or a passive inflow control device (ICD), or a combination of ICV and ICD, and one or more processing devices 360 to generate at least some of the information based on the one or more environmental conditions or to control at least the inflow control valve.

Figure 7:
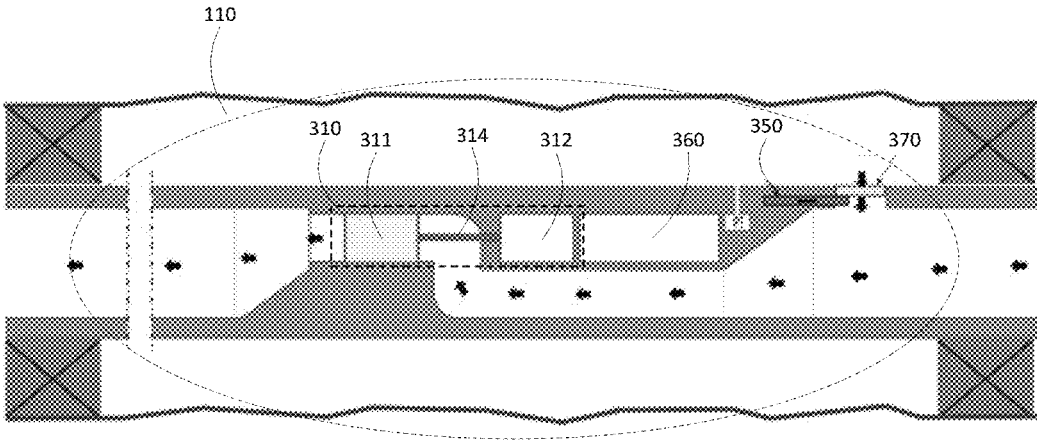
FIG. 7 is a diagram showing a cut-away, side view of an example module including a power generator, a processing and control device, an inflow control valve, and an inflow control device.
Figure 8:
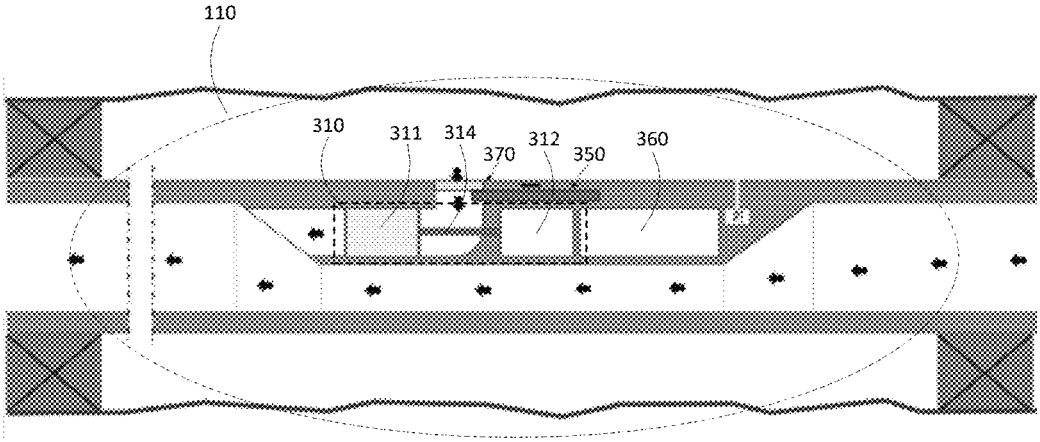
FIG. 8 is a diagram showing a cut-away, side view of an example module including a power generator, a processing and control device, an inflow control valve, and an inflow control device.
Figure 9:
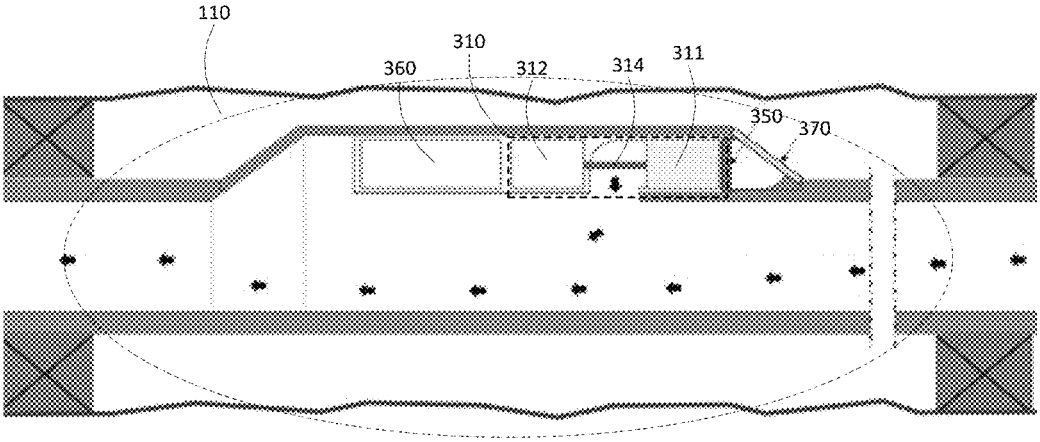
FIG. 9 is a diagram showing a cut-away, side view of an example module including a power generator, a processing and control device, an inflow control valve, and an inflow control device.

In some implementations, the well completion system transports fluids, such as hydrocarbons, from a well, or one or more compartments of the well, to the surface or another compartment. To achieve this, fluid enters the well completion system from the annulus, which is created by the tubular arrangement of the well completion system in the wellbore. In some implementations, the module can be configured with different inflow schemes. Different configurations and resulting flow schemes are shown in FIGS. 7, 8 and 9. The arrows indicate general direction of flow of fluid into and through example well completion systems.

In some implementations, individual components of module 300 are configured so that the module is spoolable. For example, individual components, such as turbine 311 and generator 312, can be connected to each other via an articulated shaft, and can be in electrical communication with other components, such as control device 370. In some implementations, turbine 311, generator 312, control device 370, communication unit 330, sensor 340, or inflow control valve 350 can be sized such that a system including one or more of these components can be spoolable. In some implementations, the components can be arranged in a single mandrel. In some implementations, the components can be arranged in a string of mandrels. In some implementations, the components can be arranged such that enough tubing is located between at least two of the components to make the system to be spoolable.

In some implementations, the inflow from the annulus of a first compartment enters a compartment string 110 of the system in a first tubular section upstream of the power generator 310 (see FIG. 7), such as turbine 311, generator 312 (connected to each other via shaft 314), or both. In some implementations, the inflow passes through active inflow control valve 350, passive inflow control device 370, or both. In some implementations, such as a multi-compartment system, this inflow from the annulus joins the fluid flowing from one or more upstream compartments, for example, before going through the turbine 311 (see FIG. 7). This can result in a system that is self-sustained in terms of energy production and that is able to operate in situations where the first compartment is isolated or the inflow is very limited. In some examples, this can enable operation without loss of power during long compartment shut-in periods, or in applications where the first compartment is isolated.

In some implementations, the inflow from the annulus of a first compartment enters a compartment string 110 of the system through power generator 310, such as through turbine 311 (see FIG. 8). In some implementations, such as in a multi-compartment system, this inflow from the annulus joins the fluid flowing from one or more upstream compartments after exiting the turbine 311 (see FIG. 8). This inflow scheme can enable full compartment flow monitoring. In some implementations, module 300 may rely only on the power capacity, for example in low flow, or no-flow situations where a power generator (for example, a turbine 311 coupled to a generator 312 via shaft 314) is not providing enough power.

In some implementations, module 300 may have a side pocket mandrel including, for example, a turbine 311 coupled to a generator 312 via shaft 314, through which fluid can enter the well completion system (see FIG. 9). This can allow full bore access for intervention. In some implementations, this configuration can enable the module 300 to be retrieved with a kick-over tool, which is a tool for delivering or retrieving objects from a side pocket mandrel, on a wireline, for example similar to swapping gauges in a side pocket mandrel.

In some implementations, module 300 can be made small enough to fit inside the side pocket mandrel. In some implementations, module 300 has an outer diameter of 1.5 inches and is less than 3 feet long. However, module 300 is not limited to these dimensions.

The well completion system can be modular. For example, the system may include a plurality of modules 300, with each module 300 being part of, or being integrated into, one compartment string in the wellbore. In some implementations, two or more compartment strings can be arranged end-to-end, for example, with a downstream end of a first compartment string being connected to an upstream end of a second compartment string.

Figure 10:
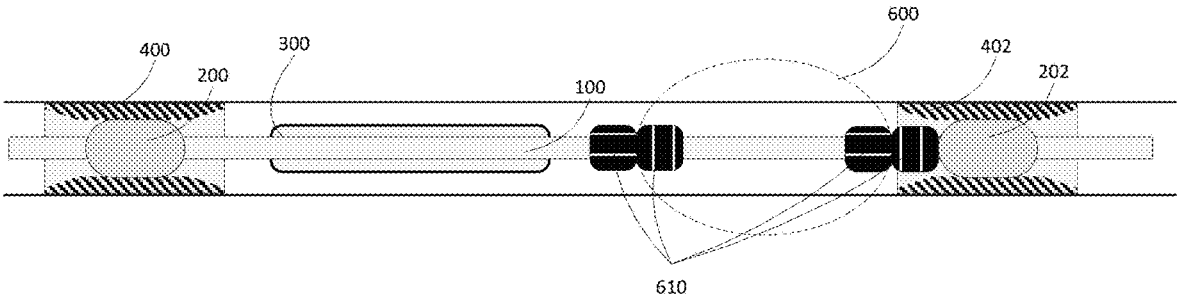
FIG. 10 is a diagram showing a cut-away, side view of an example section of a well completion system.

In some implementations, one or more spacers can be deployed between two tubing strings, with each tubing string including a module 300 (see FIG. 10). In some implementations, spacer 600 can serve as tubular construction sections to achieve a desired compartment length and to isolate a compartment or zone. In some implementations, a spacer can be deployed separately in one or more fixed length tubing sections by tractor intervention, or can be deployed as one or more longer continuous sections.

A spacer may include one or more mechanical interfaces on each end to implement a pressure-tight connection/fixation to an adjacent spacer or compartment string. In some implementations, if one or more spacers 600 are run in sections by tractor intervention, end connections 610, for example snap-latch end connections, can be fitted to allow multiple spacer modules to be built into one or more longer sections downhole. A tubular element of a spacer 600 may be of a size/diameter similar to the size/diameter of common downhole grade tubing. In some implementations, a spacer can be a part of a compartment string that is run in the hole.

Figure 11:
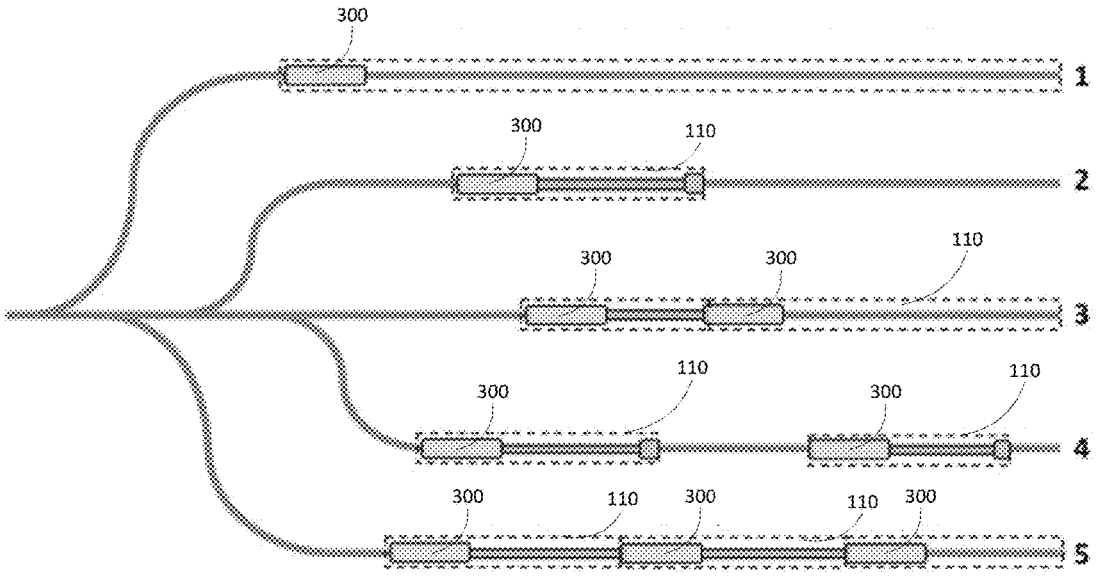
FIG. 11 is a diagram showing example deployment schemes of an example well completion system.

The well completion system can be modular and can be used in different configurations. Each individual well and lateral can be populated with a (sub-)system configuration suited for each specific need. FIG. 11 shows example alternative architectural options for the well completion system, each option shown in a separate lateral well.

In some implementations, by using only one single module 300, a lateral well can be treated as a large single compartment (FIG. 11, lateral well 1). This can enable a well operator to monitor and control each lateral well of a multiple well system separately. In some implementations, a lateral well can be divided into multiple compartments at a later stage after deployment of a first module 300, for example, in order to alleviate a problem such as a malfunction or other event requiring intervention. This option may be cost-effective and may enable lateral control with limited equipment.

In some implementations, one or more modules 300 or compartment strings 110 can be deployed to create and to isolate one or more specific regions of a well by forming one or more compartments (FIG. 11, lateral well 2). For example, if a specific water-producing zone in a well is identified, a compartment can be installed in this location, allowing an operator to monitor and control this specific zone, without the need for populating the whole lateral well.

In some implementations, one or more modules 300 or compartment strings 110 can be added to an already-deployed module 300 or compartment string 110. In some implementations, a module 300 or compartment strings 110 can be deployed and attached at the upstream end of an already-deployed module 300 or compartment string 110 (FIG. 11, lateral well 3). By adding an extra module 300 or compartment string 110, the toe part of a previously-established well can become a (new, separate) compartment. This option may enable monitoring and control of a specific zone and the toe of the well.

In some implementations, two or more modules 300 or compartment strings 110 can be deployed to create and to isolate two or more separate specific regions of a well by forming two or more compartments that are not adjacent or connected to each other (FIG. 11, lateral well 4). For example, if two or more problematic zones are identified, an appropriate compartment string can be installed in these specific locations. This can enable monitoring and control of the problematic areas of the well without the need to deploy unnecessary equipment or tubing through a large portion of a well.

In some implementations, two or more modules 300 or compartment strings 110 can be deployed to create and to isolate two or more separate specific regions of a well to fully compartmentalize the well in one initial deployment of a system (FIG. 11, lateral well 5). In some implementations, modules 300 or compartment strings 110 can be installed on demand, for example, as problems in a well are identified. By fully populating a lateral well, an operator may be able to monitor and control each individual zone to maximize production. A fully-compartmentalized lateral may also allow the operator to carry out, for example, pinpoint injection and well stimulation to each specific zone.

Different deployment methods may be used to install a well completion system. Using conventional wireline operation can mean working with limited lubricator length. A lubricator is a long high-pressure pipe on top of a well head to aid the insertion of tools into high pressure vessels. This can be inconvenient when installing large compartments, due to many installation runs to build a compartment. Wireline deployment can be beneficial due to low risk and cost, but other deployment methods, such as coiled tubing deployment methods, may be used for other implementations of the well completion system.

Downhole stacking can be implemented using standard wireline equipment or a tractor, or a combination of wireline and tractor. An example downhole stacking procedure, is shown in FIG. 12A-12D. In some implementations, this deployment method can be used for comparatively short systems. In some implementations, bottom hole assemblies (BHAs) can be run through a conventional lubricator, which normally varies from 60 to 90 feet in length.

Figure 12A:
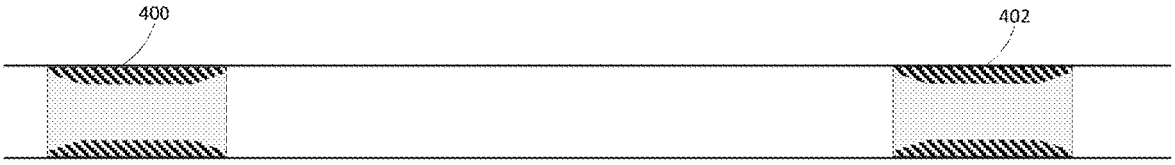
FIGS. 12A to 12D are diagrams showing a cut-away, side view of an example deployment procedure of an example section of a well completion system.
Figure 12B:
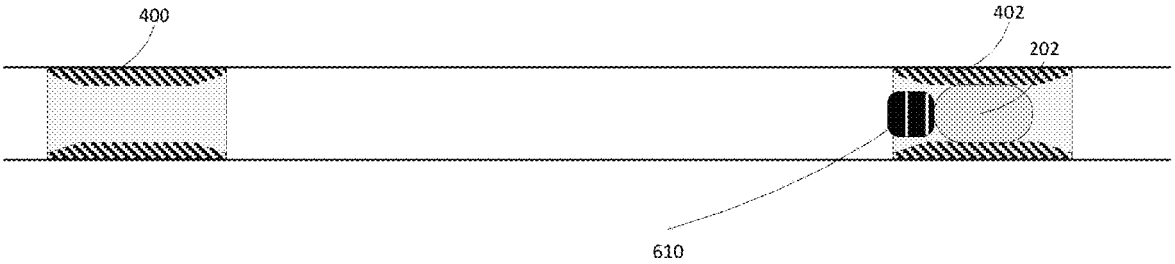

An example downhole stacking procedure, for example, for longer compartments, can be performed as shown in FIG. 12A-12D. Two anchors, such as permanent anchors 400, 402 are installed, for example, on wireline in two separate runs (FIG. 12A). First retrievable packer 202, such as a large-bore packer, can be installed, engaging permanent anchor 402 (FIG. 12B). In some implementations, first retrievable packer 202 can include a latching mechanism on end connection 610, for example, at the upstream end of the packer. The one or more latching mechanisms on end connections 610 can connect components of a string, for example, connecting spacer 600 to retrievable packer 202.

Figure 12C:
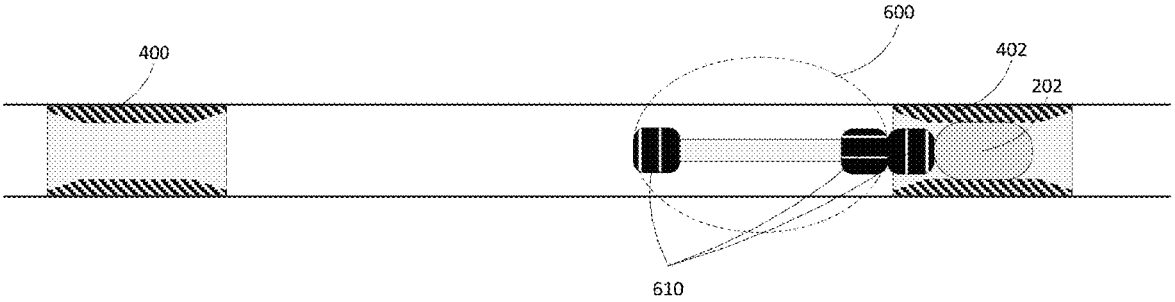
Figure 12D:
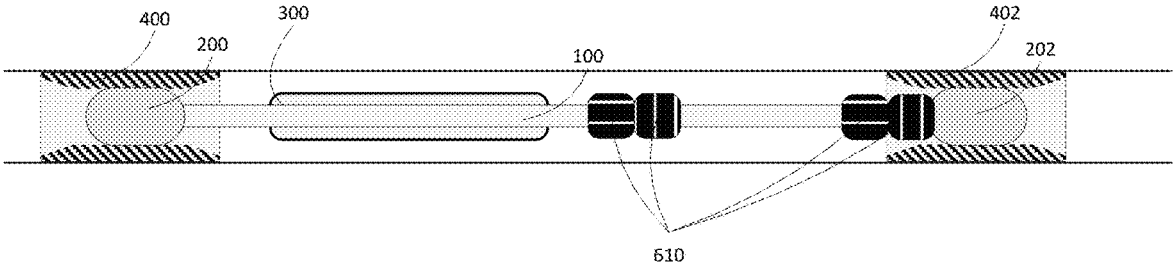

(FIG. 12C). The compartment string length can vary, depending, for example, on lubricator length. Subsequently, a second retrievable packer 200, for example, a large-bore packer, connected to a compartment string including module 300 and a latching mechanism on end connection 610 is installed, connecting to spacer 600 and deploying packer 200 in anchor 400 (FIG. 12D). Sequences of operations other than those shown in FIGS. 12A-12D may be used to deploy a well completion system including a spacer.

An example snubbing unit includes a hydraulic rig that functions in a way similar to regular rigs, but is configured to perform under pressure, for example, in an under-balanced live-well state. In some implementations, by using snubbing in combination with wireline (WL) or coiled tubing (CT) it is possible to build relatively long compartment strings. This architecture may require a snubbing unit, which is combined with a wireline or coiled tubing unit. Mobile snubbing units can typically fit on four trucks and can be rigged up in about three to four hours in some cases. Tubing joints can be built into the wellbore through the snubbing unit and conveyed to their destination by wireline or coiled tubing. If more compartments are desirable, modules 300 or compartments strings 110 can be installed consecutively as described before. Retrieval of one or more modules 300 or compartments strings 110 can be can be carried out in reverse order of the snubbing deployment procedure. The snubbing compartment architecture can also be achieved with coiled tubing.

Figure 13A:
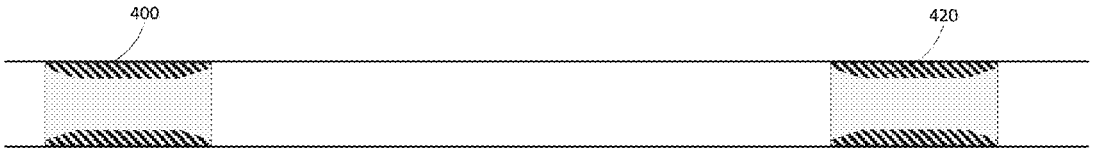
FIG. 13A to 13F are diagrams showing a cut-away, side view of an example deployment procedure of an example section of a well completion system.
Figure 13B:
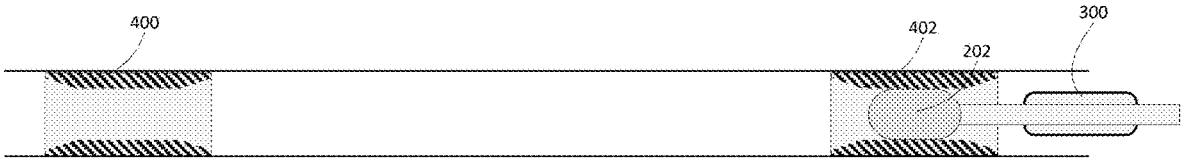
Figure 13C:
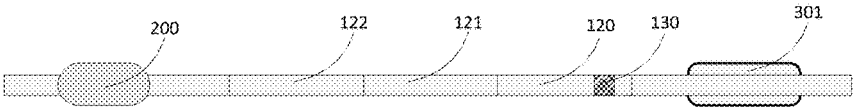
Figure 13D:
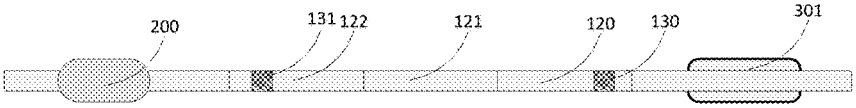
Figure 13E:
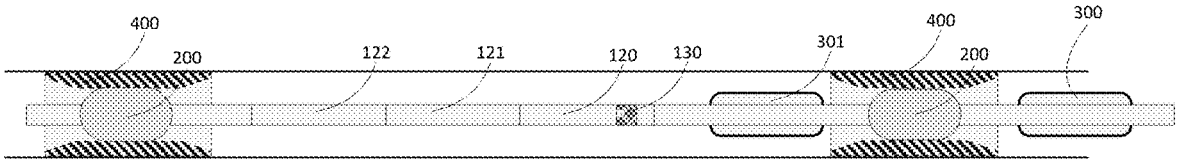
Figure 13F:
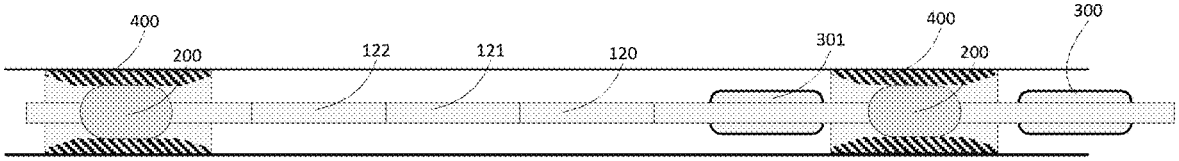

An example snubbing procedure for a well completion system is shown in FIGS. 13A-13F. In this example, two anchors 400, 402 are installed on wireline (FIG. 13A). A module 300 connected to packer 202, for example a large bore packer is run in-hole by wireline, and the packer 202 engages permanent anchor 402 (FIG. 13B). In some implementation, this unit can compartmentalize the toe of the well. A bottom hole assembly (BHA) can be built into the well through a snubbing unit, which can add more tubing joints for increased length, forming a compartment string, including module 301 (FIG. 13C). A first tubing joint 120 can have a preinstalled nipple plug 130 to ensure pressure control during building of the BHA. Additional tubing joints 121, 122 and a large bore packer, for example retrievable packer 200, can be connected. A setting tool and a tractor (wireline or coiled tubing) can be connected, and the BHA can be conveyed into the well. If desirable another nipple plug 131 can be installed in the BHA to add buoyancy to allow for a lighter BHA (FIG. 13D). The BHA can be installed and connected to the previously deployed string, for example packer 220, forming a compartment string (FIG. 13E). Then, nipple plug 131 can be retrieved (FIG. 13F). In some implementations, more compartments can be installed consecutively using the same method. Retrieval of one or more elements can be done in reverse order, starting with installing a nipple plug. Sequences of operations other than those shown in FIGS. 13A-F may be used to deploy a well completion system using a snubbing procedure.

The well completion system as can be implemented as a spoolable system. In some implementations, a spoolable system can populate a whole lateral well in one run. In some implementations, a spoolable system includes a side pocket mandrel configuration to allow for intervention in or through a deployed system to any upstream location.

In some implementations, a stackable well completion system can be used, for example stackable tubing modules with a stinger/latch mechanism. An example stinger is a short prong that can slide into a tool at an appropriate opening. A stackable system may not require any heavy duty or purpose built installation equipment. In some implementations, this system can be used for cost effective field trials and well assessments. The stackable system bottom hole assembly (BHA) length may be limited by the lubricator length. In some implementations, the lubricator length restriction may be eliminated, either by running coiled tubing, snubbing or a similar deployment method. This can allow running long compartments in few runs.

Figure 14A:
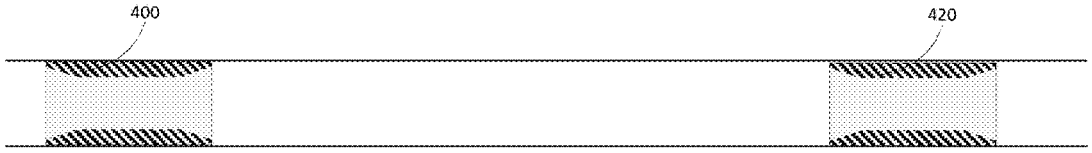
FIGS. 14A to 14F are diagrams showing a cut-away, side view of an example deployment procedure of an example section of a well completion system.
Figure 14B:
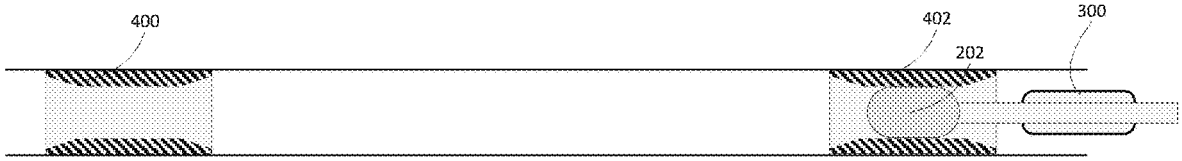
Figure 14C:
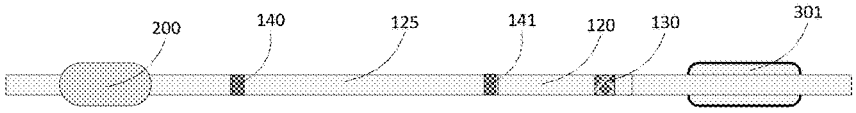
Figure 14D:
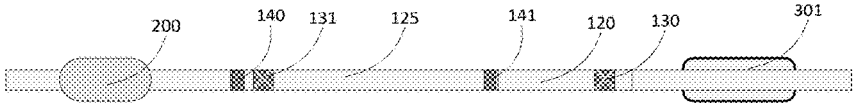
Figure 14E:
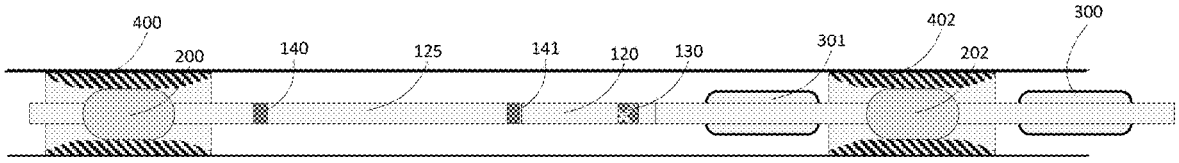
Figure 14F:
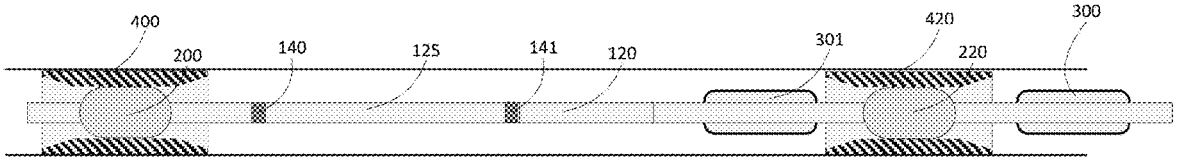

An example coiled tubing delivery procedure for a well completion system is shown in FIGS. 14A-14F. In this example, two anchors, such as permanent anchors 400, 402 are installed, for example on wireline (FIG. 14A). A module 300 connected to packer 202, for example a large bore packer, is run-in-hole by wireline, and the packer 202 engages permanent anchor 402 (FIG. 14B). In some implementation, this unit can compartmentalize the toe of the well. A bottom hole assembly (BHA) can be built into the well through a coiled tubing unit, forming a compartment string. In some implementations, a nipple plug 130 can be preinstalled on a first tubing joint 120 close to a module 301 to ensure pressure control during building of the BHA. Coiled tubing string 125 having dimple connectors 140, 141, or similar connectors, and a large bore packer, for example retrievable packer 200, can be connected to the string (FIG. 14C). A setting tool and a tractor (wireline or coiled tubing) can be connected and the BHA can be conveyed into the well. An additional nipple plug 131 can be installed in the BHA to add buoyancy to allow for a lighter BHA (FIG. 14D). A compartment string can be installed deploying packer 200 in anchor 400, and can be connected to a previous string, for example the previously installed first large bore packer 202 (FIG. 14E). Nipple plug 130 can be retrieved (FIG. 14F). Additional compartments can be installed consecutively using the same method. Retrieval of one or more elements can be done in reverse order, starting with installing a nipple plug. Sequences of operations other than those shown in FIGS. 14A-F may be used to deploy a well completion system using a coiled tubing procedure.

Figure 15A:
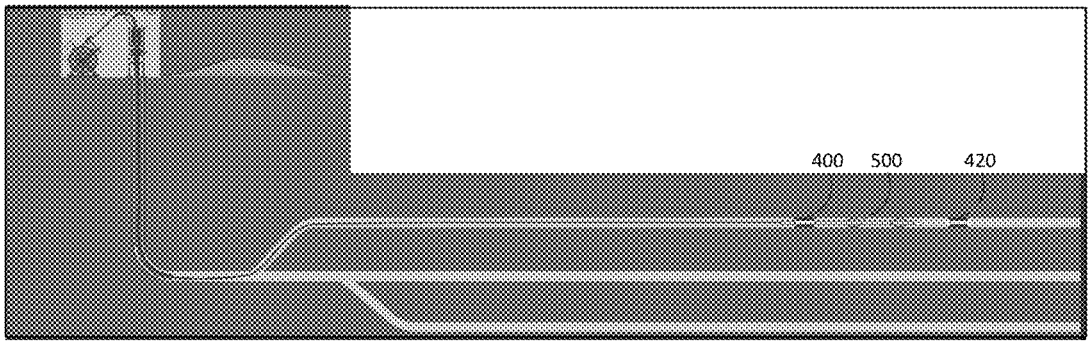
FIGS. 15A to 15D are diagrams showing a cut-away, side view of an example deployment procedure of an example section of a well completion system.
Figure 15B:
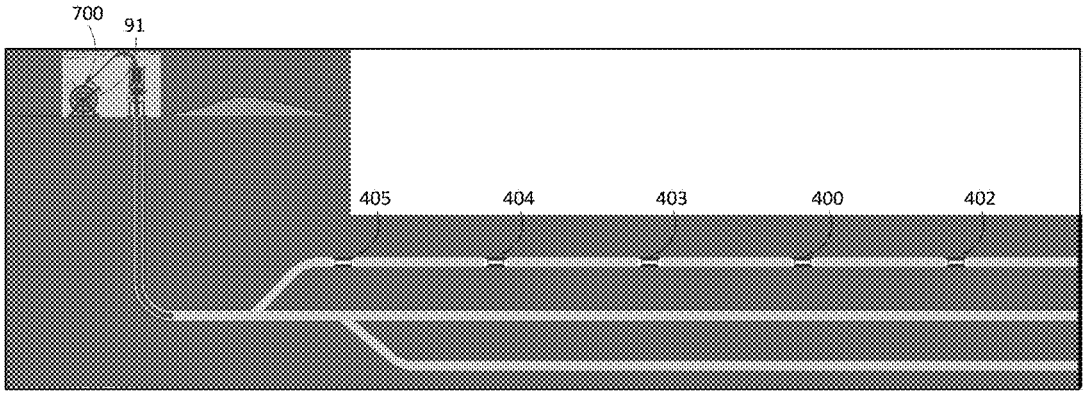
Figure 15C:
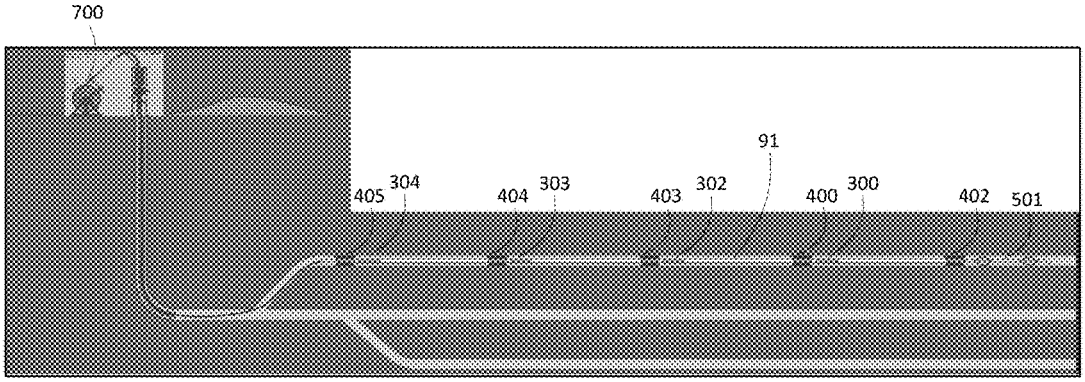
Figure 15D:
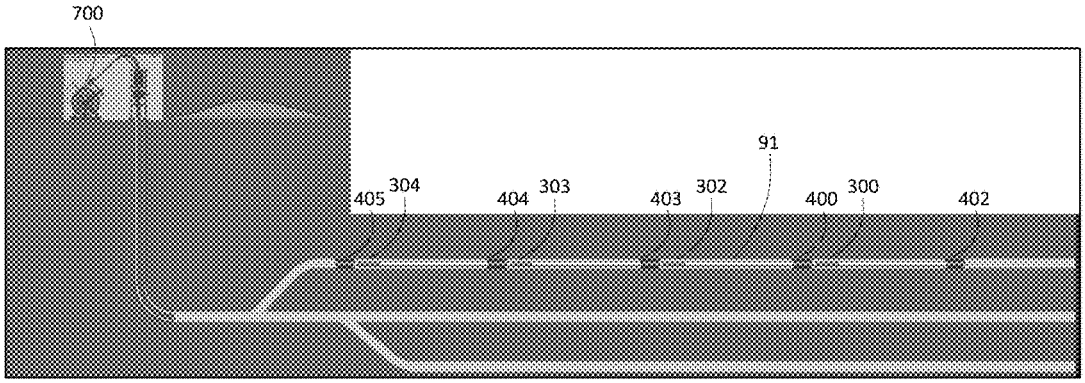

An example coiled tubing delivery system and delivery procedure is shown in FIGS. 15A-15D. In some implementations, one or more completion strings can be prepared at the surface and spooled prior to run-in-hole. In some implementations, a lateral well can be completed or compartmentalized in a single run. Two permanent anchors, such as anchors 402, 400 are deployed by through-tubing, for example on a tractor bottom hole assembly (BHA) or a tractor intervention assembly, for zonal isolation of production zones into compartment intervals (FIG. 15A). Additional permanent anchors, such as permanent anchors 403-405, can be installed as desired (FIG. 15B), The BHA, for example a tractor intervention assembly, is pulled out of hole and spoolable completion string 91 is prepared and reeled on reel 700. The spoolable well completion string 91 is run-in-hole from reel 700, for example tractor intervention assembly 501, and positioned inside the wellbore (FIG. 15C). Retrievable packers engage permanent anchors, for example 400, 402, 403-405. Tractor intervention assembly 501 is pulled out of hole (FIG. 15D). The lateral well is now compartmentalized with a module 300, 302-304 in each compartment, and I ready for production. Sequences of operations other than those shown in FIGS. 15A-D-may be used to deploy a well completion system using a coiled tubing procedure.

The well completion system can include hydraulically activated components. In some implementations, a spoolable well completion system includes a circulation sub, an example of which is a downhole tool to control flow between the pipe and annulus. In some implementations, a spoolable well completion system includes a side pocket mandrel. In some implementations, after the spoolable completion string is run-in-hole from the reel, and positioned inside the wellbore, the circulation sub, which may be mounted on a bottom hole assembly (BHA), is activated, building hydraulic pressure inside the completion string. This can cause a large bore to engage a permanent packer, for example permanent anchor 400. In some implementations, the engaged assembly is confirmed as set or deployed by analyzing a volume/pressure curve obtained from measurements using sensors on the BHA or an overpull, or both.

One or more or all components of a module 300, can be arranged to form a module that can be located inside a side pocket of a wellbore (FIG. 9). In some implementations, a resulting side pocket module can include power generator 310, energy storage unit 320, wireless communication unit 330, sensor 340, or inflow control valve 350. In some implementations, one or more or all components of a side pocket module can be retrieved and replaced, for example using a kick-over tool.

In some implementations, the well completion system may be deployed with one, more, or all of components described here. The designed modularity of the well completion system allows deploying only those components that may be needed for a specific situation. For example, a set of packers, for example extremely expandable packer (EEP), along with a piece of tubing can be used to isolate a water break-in zone in an open hole, or it can be used to deploy an (adaptive) inflow control valve. Long-range wireless communication capability along with downhole power generation from well fluid flow and high temperature long life rechargeable batteries may expand capabilities in operating in an open hole well environment.

In some implementations, as appropriate, one or more of the components described in this specification may be missing from the example well completion system, one or more alternative components may be included in the example well completion system, or one or more additional components may be substituted for one or more existing components in the example well completion system.

At least part of the well completion system and its various modifications can be controlled or implemented, at least in part, via a computer program product, for example a computer program tangibly embodied in one or more information carriers, for example in one or more tangible machine-readable storage media, for execution by, or to control the operation of, data processing apparatus, for example a programmable processor, a computer, or multiple computers.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing the systems can be performed by one or more programmable processors executing one or more computer programs to perform the functions of the calibration process. All or part of the systems can be implemented as special purpose logic circuitry, for example an FPGA (field programmable gate array) or an ASIC (application-specific integrated circuit), or both.

Processors suitable for the execution of a computer program include, by way of example, both general and special purpose microprocessors, and any one or more processors of any kind of digital computer. Generally, a processor will receive instructions and data from a read-only storage area or a random access storage area or both. Components of a computer (including a server) include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, for example magnetic, magneto-optical disks, or optical disks. Non-transitory machine-readable storage media suitable for embodying computer program instructions and data include all forms of non-volatile storage area, including by way of example, semiconductor storage area devices, for example erasable programmable read-only memory (EPROM), electrically erasable programmable read-only memory (EEPROM), and flash storage area devices; magnetic disks, for example internal hard disks or removable disks; magneto-optical disks; and CD-ROM and DVD-ROM disks.

Each computing device, such as a tablet computer, may include a hard drive for storing data and computer programs, and a processing device (for example a microprocessor) and memory (for example RAM) for executing computer programs. Each computing device may include an image capture device, such as a still camera or video camera. The image capture device may be built-in or simply accessible to the computing device.

Each computing device may include a graphics system, including a display screen. A display screen, such as a liquid crystal display (LCD) or a CRT (Cathode Ray Tube) displays, to a user, images that are generated by the graphics system of the computing device. As is well known, display on a computer display (for example a monitor) physically transforms the computer display. For example, if the computer display is LCD-based, the orientation of liquid crystals can be changed by the application of biasing voltages in a physical transformation that is visually apparent to the user. As another example, if the computer display is a CRT, the state of a fluorescent screen can be changed by the impact of electrons in a physical transformation that is also visually apparent. Each display screen may be touch-sensitive, allowing a user to enter information onto the display screen via a virtual keyboard. On some computing devices, such as a desktop or smartphone, a physical keyboard (for example a QWERTY keyboard or Arabic keyboard) and scroll wheel may be provided for entering information onto the display screen. Each computing device, and computer programs executed on such a computing device, may also be configured to accept voice commands, and to perform functions in response to such commands. For example, the process described in this specification may be initiated at a client, to the extent possible, via voice commands.

Components of different implementations described in this specification may be combined to form other implementations not specifically set forth in this specification. Components may be left out of the systems, computer programs, databases, etc. described in this specification without adversely affecting their operation. In addition, the logic flows shown in, or implied by, the figures do not require the particular order shown, or sequential order, to achieve desirable results. Various separate components may be combined into one or more individual components to perform the functions described here.

What is claimed is:

1. A system for a well, comprising:

a retrievable compartment string comprising spoolable, flexible, coiled tubing to transport fluids within the well and configured for rig-less lubrication and deployment;

an extreme expandable retrievable packer associated with the compartment string and configured to engage directly an inside wall of a wellbore to provide an annular seal to a section of a well bore of the well;

and a spoolable module assembled in tandem with the coiled tubing, the spoolable module comprising:

a power generator to generate power for the system, the power generator driven by fluid flow within the well;

a wireless communication device associated with the compartment string to exchange information with one or more components of the system;

one or more sensors associated with the compartment string to sense one or more environmental conditions in the well;

one or more processing devices associated with the compartment string to generate at least some of the information based on the one or more environmental conditions;

one or more inflow control valves to control a rate of fluid flow into the system; and a side pocket mandrel, the side pocket mandrel housing at least one of the power generator, the wireless communication device, the one or more sensors, the one or more processing devices or the one or more inflow control devices.

2. The system of claim 1, further comprising an energy storage unit to provide back-up power in cases where the power generator does not provide power.

3. The system of claim 2, where the energy storage unit comprises one or more batteries.

4. The system of claim 3, where the one or more batteries comprise one or more rechargeable batteries.

5. The system of claim 3, where the one or more batteries comprise a nonrechargeable battery.

6. The system of claim 1, further comprising one or more centralizers to engage a wall of the well bore and to bias a body of the system away from the wall.

7. The system of claim 1, further comprising a second module assembled in tandem with the coiled tubing, the second module comprising a power generator, a wireless communication device, one or more sensors, one or more processing devices, and one or more inflow control valves.

8. The system of claim 7, where the second module is retrievable.

9. The system of claim 1, where the power generator comprises a turbine-generator system to generate electrical power for electrical devices associated with the module.

10. The system of claim 1, where the power generator comprises a hydraulic vane motor-generator system to generate electrical power for electrical devices associated with the module.

11. The system of claim 1, where the one or more sensors comprise at least one of: a pressure sensor, a temperature sensor, a flow meter, a water cut sensor, or an inflow control valve position sensor.

12. The system of claim 11, where the pressure sensor is configured to sense a pressure of fluid surrounding the module, the pressure of fluid being one of the environmental conditions in the well.

13. The system of claim 11, where the temperature sensor is configured to sense a temperature of fluid surrounding the module, the temperature of fluid being one of the environmental conditions in the well.

14. The system of claim 11, where the flow meter is configured to sense a flow rate of fluid into the module.

15. The system of claim 11, where the water cut sensor is configured to sense water content of fluid surrounding the module.

16. The system of claim 11, where the inflow control valve position sensor is configured to sense a position of an inflow control valve, where the inflow control valve is configured to regulate a flow rate of fluid into the module.

17. The system of claim 1, where the one or more processing devices comprise a control unit, where the control unit is configured to control an active inflow control valve regulating a flow rate of fluid into the module.

18. The system of claim 1, where the retrievable compartment string is a first retrievable compartment string and the module is a first module, where the system comprises a spacer, and where the spacer is for separating the first retrievable compartment string from a second retrievable compartment string, the second retrievable compartment string comprising a second spoolable module, the second spoolable module comprising:

a second power generator to generate power for the second module from fluid flow within the well;

a second wireless communication device to exchange second information with one or more components of the system;

one or more second sensors to sense one or more environmental conditions in the well;

one or more second processing devices to generate at least some of the second information based on the one or more environmental conditions; and one or more second inflow control valves.

19. The system of claim 18, where the spacer comprises a latching mechanism, or a polished bore receptacle, or both.

20. A method comprising:

deploying, into a well comprising a wellbore, a system comprising a retrievable compartment string to transport fluids within the well and configured for rig-less lubrication and deployment and a spoolable module assembled in tandem with the coiled tubing and comprising a side pocket mandrel, the side pocket mandrel housing at least one of a power generator, a wireless communication device, one or more sensors, one or more processing devices, or one or more inflow control devices;

deploying an extreme expandable retrievable packer associated with the compartment string and configured to engage directly an inside wall of a wellbore to provide an annular seal to a section of the well bore;

generating power for the module in the wellbore, the power being generated using a power generator driven by fluid flow within the wellbore;

sensing one or more environmental conditions within the wellbore, the sensing being performed by one or more sensors associated with the module;

generating information based on the one or more environmental conditions, the information being generated by one or more processing devices included in the module; and communicating at least some of the information to one or more other components of the system, the communicating being performed by a wireless communication device.

* * * * *